United States Patent [19]

Peters et al.

[11] Patent Number: 4,567,632

[45] Date of Patent: Feb. 4, 1986

[54] HEAT EXCHANGE TUBE REPAIRS

[75] Inventors: Alan W. Peters, Warrington; Owen Hayden, Bolton, both of England

[73] Assignee: National Nuclear Corporation Limited, London, England

[21] Appl. No.: 624,204

[22] Filed: Jun. 25, 1984

[30] Foreign Application Priority Data

Jul. 1, 1983 [GB] United Kingdom ..... 8317997

[51] Int. Cl.[4] ..... B21D 53/08

[52] U.S. Cl. ..... 29/157.3 C; 228/107; 29/157.4; 29/421 E; 29/424; 29/402.09; 29/402.18

[58] Field of Search ..... 228/107; 29/157.3 R, 29/157.3 C, 157.4, 402.01, 402.02, 402.09, 402.18, 421 E, 423, 424

[56] References Cited

U.S. PATENT DOCUMENTS 3,409,969 11/1968 Simons et al. ..... 29/421 E X
3,668,080 6/1972 Weber et al. ..... 29/423 X

FOREIGN PATENT DOCUMENTS 1450143 9/1976 United Kingdom ..... 29/421 E
1472904 3/1977 United Kingdom .
2100386 12/1982 United Kingdom .

OTHER PUBLICATIONS

Fred C. Peters, "Ultra-Low-Melting Alloys, 1-1944.

*Primary Examiner*—Howard N. Goldberg
*Assistant Examiner*—John T. Burtch
*Attorney, Agent, or Firm*—William R. Hinds

[57] ABSTRACT

In a method of repairing a defective tube in a tube-in-shell heat exchanger by inserting a tubular repair sleeve within the defective tube and sealingly bonding one end region of the sleeve to the tube and the other end region of the sleeve to the tube sheet in a manner such that the defect (for example a defective tube/tube sheet weld) is bridged, the improvement of providing a support against which the said one end of the sleeve can be explosively welded to the tube. The support comprises a mass of low melting point alloy cast around the tubes so as to provide support at the welding level for the defective tube as well as surrounding tubes. The support is removed after welding by remelting the alloy and causing the liquid alloy to run away. Inserts of high melting point metal can be included in the mass as reinforcement, and the casting can be effected in a removable box of which the tube sheet forms the base, the walls surrounding at least a part of the tube array which includes the defective tube. Examples of suitable alloys are given.

7 Claims, 1 Drawing Figure

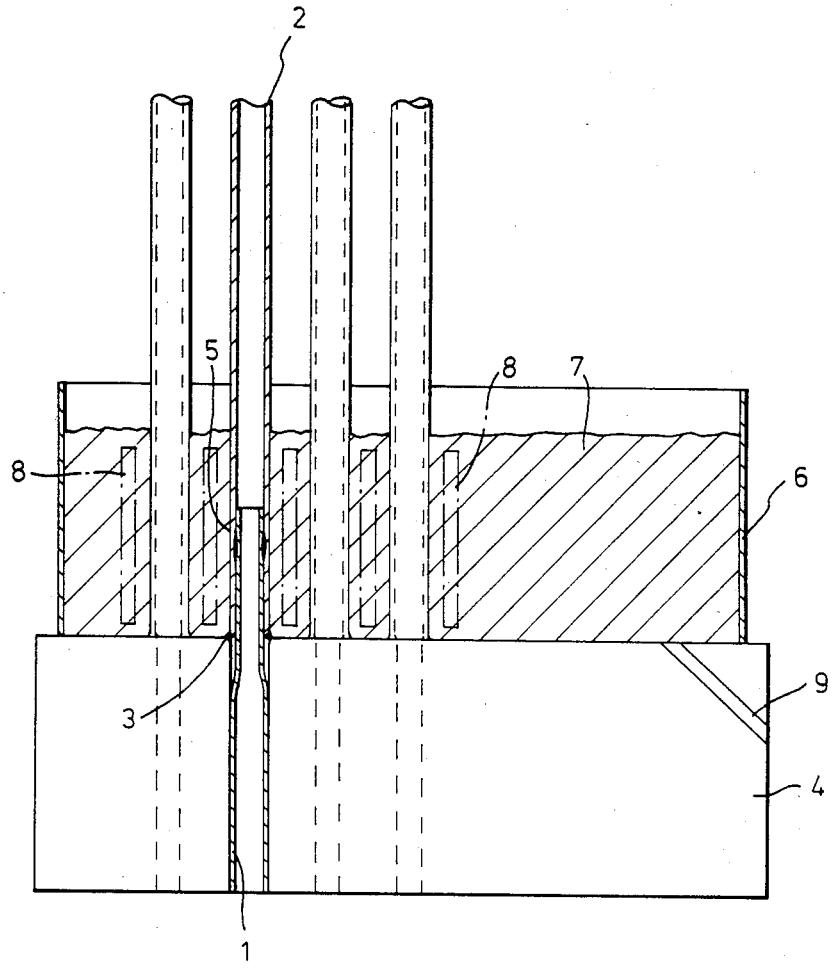
2
5
8
7
8
6
3
9
4
1

HEAT EXCHANGE TUBE REPAIRS

BACKGROUND OF THE INVENTION

British Patent Specification No. 2,032,559 discloses a method of repairing a defective tube in a tube-in-shell heat exchanger which avoids plugging the tube and which consists of inserting a tubular sleeve within the defective tube and sealingly bonding the end regions of the sleeve to the tube and the tube sheet to bridge the defect. The means of sealingly bonding the sleeve included brazing both end regions, or brazing one end region of the sleeve to the tube and explosively welding the other end region of the sleeve to the tube sheet.

It is obviously more convenient from a practical point of view to employ similar sealing techniques for both end regions of the sleeve. Explosive welding is a technique which has proved to be effective and consistent in this context, whilst brazing, though generally effective, is less easy to perform in a reliable and consistent manner. It is therefore an object of the invention to provide a method whereby explosive welding can be applied to the sealing of the repair sleeve to the heat exchanger tube whilst being disposed therewithin.

The main problem involved in the application of such a sealing technique is the lack of support against the radially outward force generated by the explosion, contrasted with the situation at the other end of the repair sleeve where the mass and dimensions of the tube sheet provide a more than adequate self-support. The proximity of the heat exchanger tubes in a typical array makes it almost impossible to provide a temporary fully radial support which can be assembled and removed easily and rapidly.

FEATURES AND ASPECTS OF THE INVENTION

This problem can be solved, according to the invention, by including in a method of repairing a defective tube in a tube-in-shell heat exchanger which method involves inserting a tubular repair sleeve within the defective tube and sealingly bonding the end regions of the sleeve to the tube and the tube plate to bridge the defect, the steps of providing a support against which the relevant end region of a sleeve can be explosively welded to a heat exchanger tube in a tube-in-shell heat exchanger, such support consisting of a mass of low melting point alloy cast so as to occupy a position in which support around the tube at the welding level is provided and in which surrounding tubes in the array are also supported, and removing the support by remelting of the mass of alloy after the explosive weld has been effected.

The term 'low melting point' is to be understood to convey the meaning of low in comparison to the melting points of materials used for the said tubes and tube sheets, such as steels with high melting points, for example in excess of 1400° C.

Preferably the alloy is such as to have a small coefficient of expansion by volume on changing from liquid to solid. This ensures that positive support is given to the relevant tube and also to surrounding tubes to avoid distortion thereof. Alloys which contain bismuth have this phenomenon of expansion and typical examples are OSTALLOY 158, nominal composition 13.3% Sn, 50% Bi, 26.7% Pb and 10% Cd with a melting point of 70° C., and OSTALLOY 281, nominal composition 42% Sn, 58% Bi, melting point 138.5° C., the latter alloy having a greater hardness and a higher ultimate tensile strength (UTS) than the former.

Reinforcement of the support mass can be provided by inserts of normal or high melting point metals, e.g. steels, placed in position before casting and removed after remelting and removal of the low melting point alloy.

DESCRIPTION OF THE DRAWING

An example of a method embodying the invention will now be described with reference to the accompanying FIGURE of the drawing, wherein the sole FIGURE is a diagrammatic and framentary side view in section.

DESCRIPTION OF THE PREFERRED EMBODIMENT

Referring to the drawing, we provide a method of repairing a defective tube in a tube-in-shell heat exchanger by employing a repair sleeve in the manner set forth in British Patent Specification No. 2,032,559 by explosively welding one end region of the sleeve to the tube sheet as described in that specification, which also discloses the other end of the sleeve being brazed to the defective tube so as to bridge the defect and to seal with the tube. Instead of employing brazing, the present invention envisages explosive welding as a sealing technique to be employed. To this end, the repair sleeve 1 has its tube-engaging end reduced in diameter to be a sliding fit in the tube 2 in a position so that the sleeve 1 bridges a defective tube-to-tube-sheet weld 3, with the tube sheet-engaging end of the sleeve 1 explosively welded to the tube sheet 4 as referred to hereinbefore. In order to provide support against explosively welding the sleeve 1 to the tube 2 at region 5, the heat exchanger is inverted so that the tube sheet 4 is lowermost, and a box 6 is temporarily secured to the tube sheet 4 so as to provide a tank with the tube sheet 4 as bottom. Low melting point alloy in liquid form, for example one of those referred to hereinbefore, is poured into the tank to a depth such that the region 5 is situated at approximately half the depth of the liquid metal and the tube 2 is completely surrounded by a support 7 provided by the solidified liquid metal as it cools to ambient temperature, the box 6 functioning as a mould for casting the support 7. Suitable reinforcement inserts, shown by dot-and-dash lines 8, may be prepositioned at appropriate locations. The support 7 also surrounds tubes adjacently surrounding the tube 2 so as to avoid distorting them as well as tube 2 when an explosive charge is detonated at the level of region 5 to effect the explosive weld thereat.

After effecting the explosive weld, the support 7 is reheated to melt it and is run off via an outlet 9, any reinforcement inserts also being removed. Finally the box 6 is dismantled and the heat exchanger is restored to its pre-inverted position. It may be necessary to coat the tube 2 and surrounding tubes with a medium, known per se, to prevent the low melting point alloy from sticking to the tubes, such medium being removed after welding by steam cleaning or by solvent.

It may also be expedient, in heat exchangers with a very large number of tubes, to construct the box at a localised region rather than round the entire tube sheet. This is perhaps made easier when heat exchangers of concentric tube design are the subject of repair.

We claim:

1. In a method of repairing a defective tube in a tube-in-shell heat exchanger having a tube sheet and a tube array which method includes the steps of inserting a tubular repair sleeve within the defective tube and sealingly bonding one end region of the sleeve to the tube and the other end region of the sleeve to the tube sheet in a manner such that the defect is bridged, the improvement comprising the steps of providing a support against which the said one end of the sleeve can be explosively welded to the tube, such support comprising a mass of low melting point alloy cast so as to occupy a position in which support around the tube at the welding level is provided and in which surrounding tubes in the tube array are also supported, effecting an explosive weld, and removing the support after welding by remelting the mass of alloy and causing the liquid alloy to flow away from the said position.

2. A method according to claim 1, wherein the said alloy has the property of a small coefficient of expansion by volume on changing from liquid to solid.

3. A method according to claim 2, wherein the said alloy contains bismuth.

4. A method according to claim 2, wherein the said alloy has a nominal composition of 13.3% Sn, 50% Bi, 26.7% Pb and 10% Cd, and a melting point of 70° C.

5. A method according to claim 2, wherein the said alloy has a nominal composition of 42% Sn and 58% Bi, and a melting point of 138.5° C.

6. A method according to claim 1, including reinforcing the support mass by placing in position, before casting the support mass, inserts of high melting point metal, and removing such inserts after remelting.

7. A method according to claim 1, including the steps of constructing a box with the said tube sheet as base and with the wall of the box surrounding at least a part of the tube array which includes the defective tube, employing the box as a mould for the casting of the said support mass, and dismantling and removing the box after remelting and removal of the support mass.

* * * * *